US011199019B1

(12) United States Patent
Ramadan et al.

(10) Patent No.: US 11,199,019 B1
(45) Date of Patent: Dec. 14, 2021

(54) ADJUSTABLE POST-TO-SUBSTRATE EMBED SYSTEM

(71) Applicant: Feeney, Inc., Oakland, CA (US)

(72) Inventors: Farouk Ramadan, Camas, WA (US); George Shevchuk, San Francisco, CA (US)

(73) Assignee: Feeney, Inc., Oakland, CA (US)

( * ) Notice: Subject to any disclaimer, the term of this patent is extended or adjusted under 35 U.S.C. 154(b) by 0 days.

(21) Appl. No.: 17/164,171

(22) Filed: Feb. 1, 2021

(51) Int. Cl.

| | |
|---|---|
| ***E04H 12/22*** | (2006.01) |
| ***E04H 17/22*** | (2006.01) |
| ***E04G 17/12*** | (2006.01) |
| ***E04G 13/00*** | (2006.01) |
| ***E02D 27/42*** | (2006.01) |
| *E04B 1/38* | (2006.01) |

(52) U.S. Cl.
CPC ..... *E04H 12/2284* (2013.01); *E02D 27/42* (2013.01); *E04G 13/00* (2013.01); *E04G 17/12* (2013.01); *E04H 17/22* (2013.01); *E04B 2001/405* (2013.01)

(58) Field of Classification Search
CPC . E04H 12/2284; E04H 17/22; E04H 12/2261; E04B 1/4157; E04B 2001/405; E02D 27/42; E02D 2250/0023; E04G 21/185; E04G 17/12; E04G 17/14; E04G 13/00; E04F 11/1812
See application file for complete search history.

(56) References Cited

U.S. PATENT DOCUMENTS

| | | | | |
|---|---|---|---|---|
| 2,625,815 A | | 1/1953 | Black | |
| 3,150,429 A | * | 9/1964 | Shaffer | E04B 1/4157 249/207 |
| 3,912,218 A | * | 10/1975 | Lister | B28B 7/0044 249/207 |
| 4,194,237 A | * | 3/1980 | Conklin | F21V 21/10 362/253 |
| 4,261,544 A | * | 4/1981 | Addison | B28B 23/005 249/207 |
| 4,412,407 A | | 11/1983 | Melfi et al. | |

(Continued)

FOREIGN PATENT DOCUMENTS

CN 109024656 A * 12/2018

OTHER PUBLICATIONS

Search Report and Written Opinion dated Apr. 14, 2021 issued in International Patent Application No. PCT/US21/16053.

*Primary Examiner* — Brent W Herring
(74) *Attorney, Agent, or Firm* — Cozen O'Connor

(57) ABSTRACT

An adjustable railing post-to-substrate embed system for anchoring a railing post having a railing base with plural railing base anchor holes includes: a plate, having anchor holes; a plurality of nuts, a first end of each nut being arranged proximate a respective one of the anchor holes, the first end of each nut being configured to be selectively and removably threadingly engaged, via the respective anchor hole, with one selected from the group consisting of: respective upper protective bolts, and respective bolts of the railing base; and a plurality of anchors, each being configured to adjustably threadingly engage a second end of a respective one of the nuts, distal the respective anchor hole, each of the anchors being individually adjustable in length by threadable engagement with the second end of the respective one of the nuts.

17 Claims, 17 Drawing Sheets

(56) References Cited

U.S. PATENT DOCUMENTS

| | | | | |
|---|---|---|---|---|
| 4,438,607 | A | 3/1984 | Nelson | |
| 4,736,554 | A | 4/1988 | Tyler | |
| 5,337,534 | A * | 8/1994 | Nasca | E04B 1/0007 249/93 |
| 5,670,076 | A * | 9/1997 | Leek | E04G 21/185 249/219.1 |
| 6,754,999 | B1 | 6/2004 | Urbanczyk | |
| 7,445,192 | B2 * | 11/2008 | Gridley | E04B 1/4157 249/207 |
| 7,533,506 | B2 * | 5/2009 | Platt | E04H 12/2261 52/296 |
| 2001/0037611 | A1 | 11/2001 | Cornett, Sr. | |
| 2005/0284083 | A1 * | 12/2005 | Gridley | E04B 1/4157 52/698 |
| 2006/0283137 | A1 * | 12/2006 | Nold | E04G 21/185 52/742.14 |
| 2008/0265128 | A1 | 10/2008 | Hughes | |
| 2012/0031015 | A1 | 2/2012 | Dent | |
| 2013/0067849 | A1 | 3/2013 | Espinosa | |

* cited by examiner

ADJUSTABLE POST-TO-SUBSTRATE EMBED SYSTEM

BACKGROUND OF THE INVENTION

1. Field of the Invention

The present invention relates to systems and assemblies to embedding structures into concrete.

2. Related Art

Conventional methods for connecting, for example, guard rails in concrete structures, such as concrete structures comprising a slab or stem wall in commercial and residential buildings, have difficulties in regard to simplicity, cost and sturdiness. Such systems typically provide an embedded mounting plate for railing systems to weld to once the finished concrete is installed.

FIGS. 1A and 1B are views showing a typical conventional embed plate system 100. System 100 is for affixing a guide rail 102, typically to edges of a concrete structure. The system 100 includes an embedding plate assembly 103 including a mounting plate 104, legs 106 and base flanges 108.

As seen in FIG. 1A, the plate assembly 103 is installed in concrete so that the mounting plate 104 is substantially flush with the concrete surface level. In this position, the legs 106 descend vertically away from the mounting plate 104 and the flanges 108 can be used, for example, to support the plate assembly 103, or to float in the concrete, such that, when the concrete has hardened, the flanges 108 provide an anchoring function.

Upon hardening of the concrete, the surface of the mounting plate can be cleaned to provide a clean surface onto which a bottom portion of posts 102 of a railing system can be welded.

This system has disadvantages, one of which is that a welding connection requires two pieces of steel, and requires the mating surfaces of the welded parts to be very clean, which may be a problem when concrete has recently covered one of the components to be welded.

Another conventional welding plate unit 200 is shown in two perspectives in FIGS. 2A and 2B. This structure 200 has a two-level construction with a bottom plate 202 having mounting holes 204 that allow the bottom plate 202 to be bolted onto a surface of the concrete landing, and an offset upward post 206 that leads to a mounting plate 208.

In this unit 200, the offset arrangement allows for placement of the railing further out toward the perimeter of the landing than the bolts, providing more usable space on the patio. Once waterproofing and concrete installation is complete, the railing is welded to the mounting plates to provide the railing system.

Other known solutions for post-to-concrete attachment solutions include securing with expansion anchors, specific hi-lo bolts, core mount, or block out installation—all of which, for various reasons, are generally less than ideal in a shallow depth slab. The expansion anchors increase the risk of breaking up the concrete, resulting in a bad structural connection. Such failures are likely to be deep in the slab and invisible from the surface.

Thus, there is a need for an adjustable post-to-substrate embed system which is safe, cost effective and easy to install.

SUMMARY OF THE INVENTION

An object of the invention is to provide a lightweight, inexpensive and durable post-to-substrate embed system.

The examples provided below will generally discuss attachment of a railing post with a railing base plate. Examples of railing posts are, for example a guardrail post, or fence post. Thus, the discussion of, for example, railings, or railing posts, equally applies to guardrails, guardrail posts, fences and fence posts, which all may have similar base plates. The term "railing" herein may refer to a guardrail or a fence, and the term "railing post," therefore, may refer to a guardrail post or a fence post, or other similar structures.

In accordance with an aspect of the present invention, there is provided a system including a plate with anchors, placed to align with railing base plate mounting holes, a bracket for adjustably placing the plate on an edge of a concrete containment form, which may be, for example, a pan, with adjustability, by which a consistent placement for alignment of the railing is achieved.

In accordance with another aspect of the present invention, an adjustable railing post-to-substrate embed system for anchoring a railing post having a railing base with plural railing base anchor holes includes: a plate, having anchor holes; a plurality of nuts, a first end of each nut being arranged proximate a respective one of the anchor holes, the first end of each nut being configured to be selectively and removably threadingly engaged, via the respective anchor hole, with one selected from the group consisting of: respective upper protective bolts, and respective bolts of the railing base; and a plurality of anchors, each being configured to adjustably threadingly engage a second end of a respective one of the nuts, distal the respective anchor hole, each of the anchors being individually adjustable in length by threadable engagement with the second end of the respective one of the nuts, so that the distance between an anchor and its corresponding anchor hole can be modified relative to the distance between another of the anchors and its respective anchor hole. That is, while the lateral spacing between the anchors is fixed, the depth of the anchors is adjustable.

In another aspect, each anchor comprises a lower bolt and a washer.

In another aspect, the system further comprises: a bracket having a bent end configured to fixedly engage the bracket to an edge of a concrete containment form via bent end screws, and configured to adjustably arrange the plate with respect to the edge of the metal concrete containment form by affixing the bracket to the plate.

In another aspect, the upper protective bolts are configured to be arranged in the first end of the nut, and then selectively removed after a hardening of concrete in the containment form, which can be for a slab, a stem wall or a concrete column.

In another aspect, the bracket is affixed to the plate by a plate contact screw, and wherein the bracket comprises a slot through which the plate contact screw passes for the adjustable arrangement of the plate with respect to the edge of the concrete containment form.

In another aspect, in a case in which the concrete has not yet hardened the selected group consists of the respective upper protective bolts.

In another aspect, in a case in which the concrete has hardened, the selected group consists of the respective bolts of the railing base.

In another aspect, each anchor comprises a lower bolt and a washer, and the concrete containment form comprises reinforcers, configured to provide reinforcement to the hardened concrete, the length of each anchor being adjustable prior to applying the concrete so as to avoid contact with the reinforcers, that is, to prevent conflict with the structural steel reinforcement prior to the concrete application.

In another aspect, each nut comprises first threading at the first end, for threadingly engaging a bolt, and second threading at the second end, for threadingly engaging a respective one of the anchors.

In another aspect, the plate is made of plastic.

In another aspect, the plate is made of metal.

In another aspect, the protective railing bolts and railing base bolts are the same.

In another aspect, the protective railing bolts and railing base bolts are different.

In another aspect, the concrete containment form comprises a metal concrete pour pan.

In another aspect, the railing comprises a guardrail.

In another aspect, the railing comprises a fence.

Advantages of the present invention include providing a simpler adjustable railing post-to-substrate embed system that allows for precise and straight guardrail or fence installation while maintaining structural integrity. Other advantages are that off the shelf fasteners can be used, such as bolts, nuts and washers, a longer bolt can be used when depth and structural obstacles are not an issue. Welding is not required. Another advantage is that the only two fabricated components are the plate, which can be made of plastic, and the bracket.

The system also provides for faster and stronger installation and maintains structural integrity, while preventing a false sense of security due to concrete splitting concrete delamination or oversized hole.

The present invention also prevents short-term and long-term unintended damage to edge bar and post tension cables that are typical with core drill and wedge anchor applications. Greatly reduced long-term cost of maintenance and ownership are also achievable.

The system provides flat plates with vertical nuts, and bolts and washers forming anchors, the depth of which anchors is easily adjustable by twisting of a bolt of the anchor into or out of the nut. This adjustability provides flexibility to control the depth of the anchors, for example around obstacles such as structural steel used in the reinforcement of concrete. The threaded anchor permits the adjustment of the depth of the anchors for deeper or shallower positions offering flexibility while maintaining adequate holding power. Depending on the application different length bolts can be used.

The flat washer at each anchor position offers a wide area of resistance in a 360-degree direction distributing the stress to a larger area of the concrete. Unlike a bent anchor such as a "J-bolt" the area under stress is concentrated at the top radius of the anchor, causing the anchor to act as a wedge while exerting forces capable of causing concrete failure.

BRIEF DESCRIPTION OF THE DRAWINGS

The above and/or other aspects and advantages will become more apparent and more readily appreciated from the following detailed description of the disclosed embodiments taken in conjunction with the accompanying drawings in which.

DETAILED DESCRIPTION OF THE DISCLOSED EMBODIMENTS

The present invention provides an adjustable railing post-to-substrate embed system that allows for precise and straight railing (such as a guardrail or a fence) installation while maintaining waterproofing membrane integrity. As will be developed below, the system uses, for example, a plate, that can be molded of plastic, with 4 anchors, placed to match base plate mounting holes of a railing system. Also provided is a bracket for placing the system on an edge of a concrete containment form, which is shown for example, in the illustrated examples, as a metal concrete pour pan, with adjustability, which allows for consistent placement for alignment.

Figure 1A:
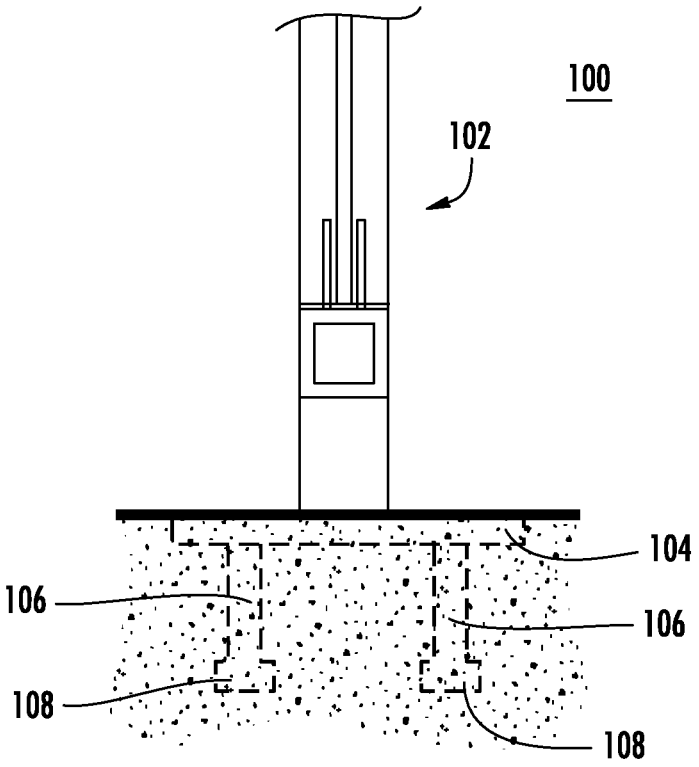
FIG. 1A (Prior Art)
FIGS. 1A and 1B are views showing a typical conventional embed plate system.
Figure 1B:
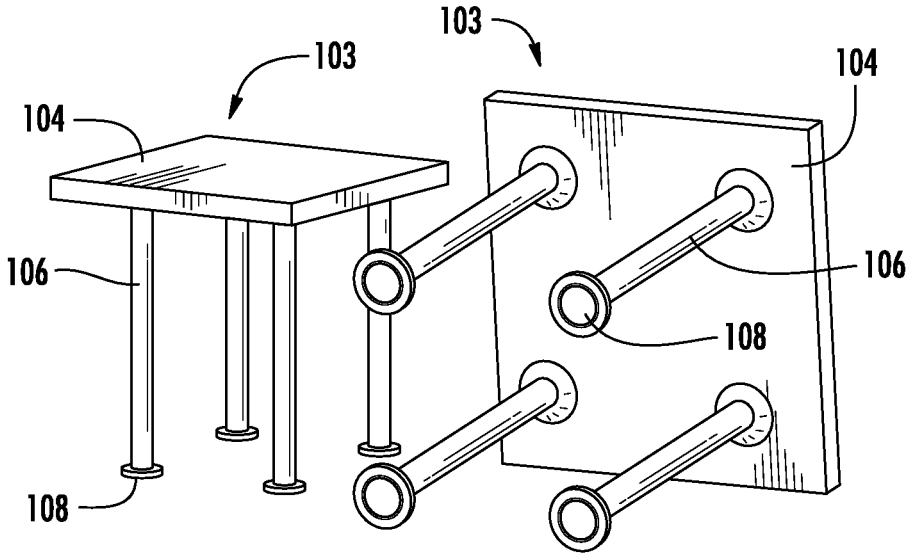
FIG. 1B (Prior Art)
Figure 2A:
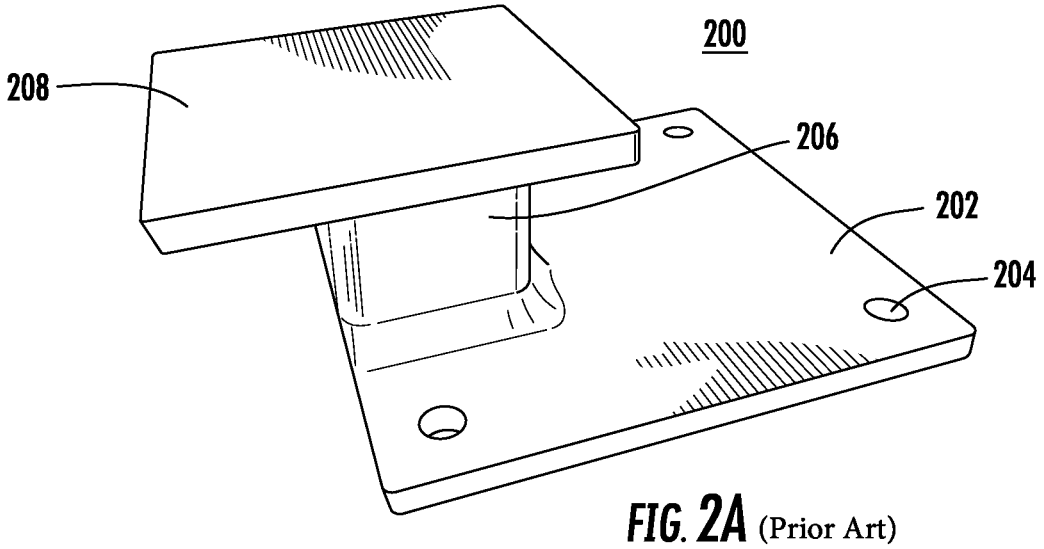
FIG. 2A (Prior Art)
FIGS. 2A and 2B are views of another conventional welding plate unit for embedding a railing in concrete.
Figure 2B:
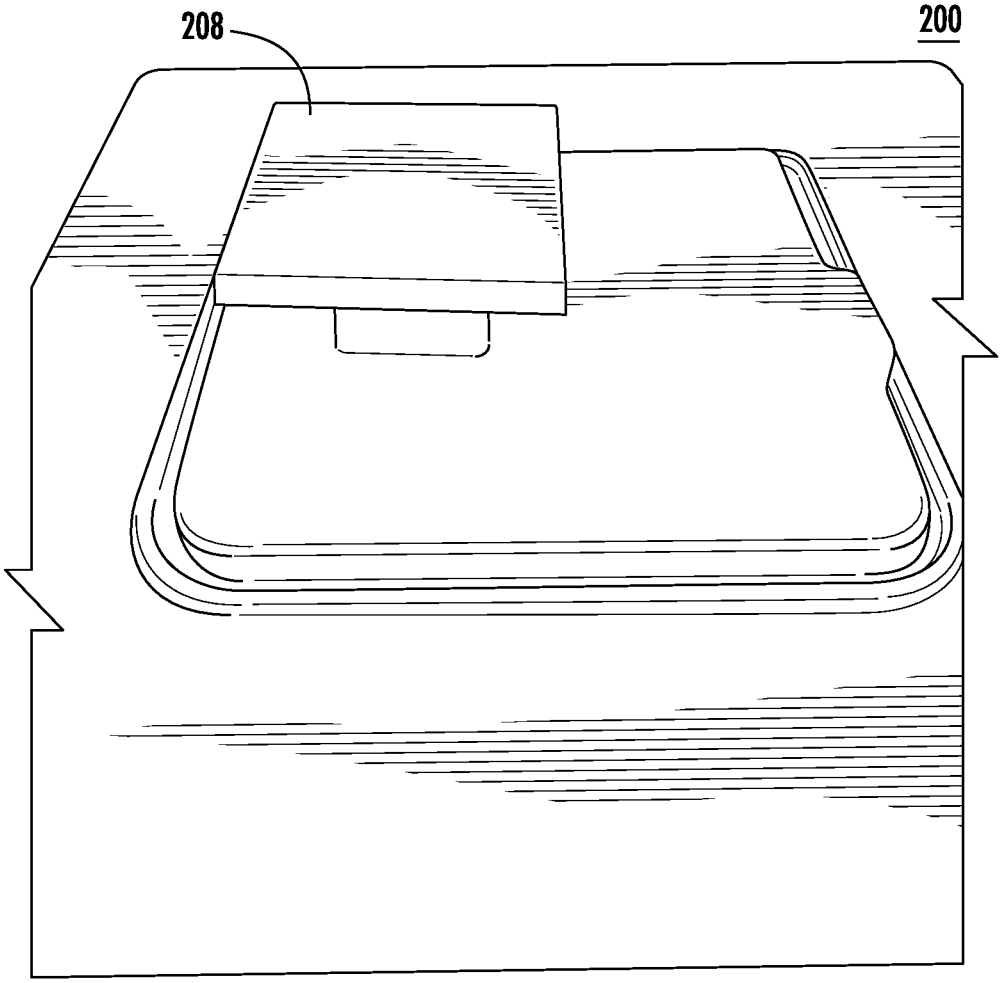
FIG. 2B (Prior Art)
Figure 3A:
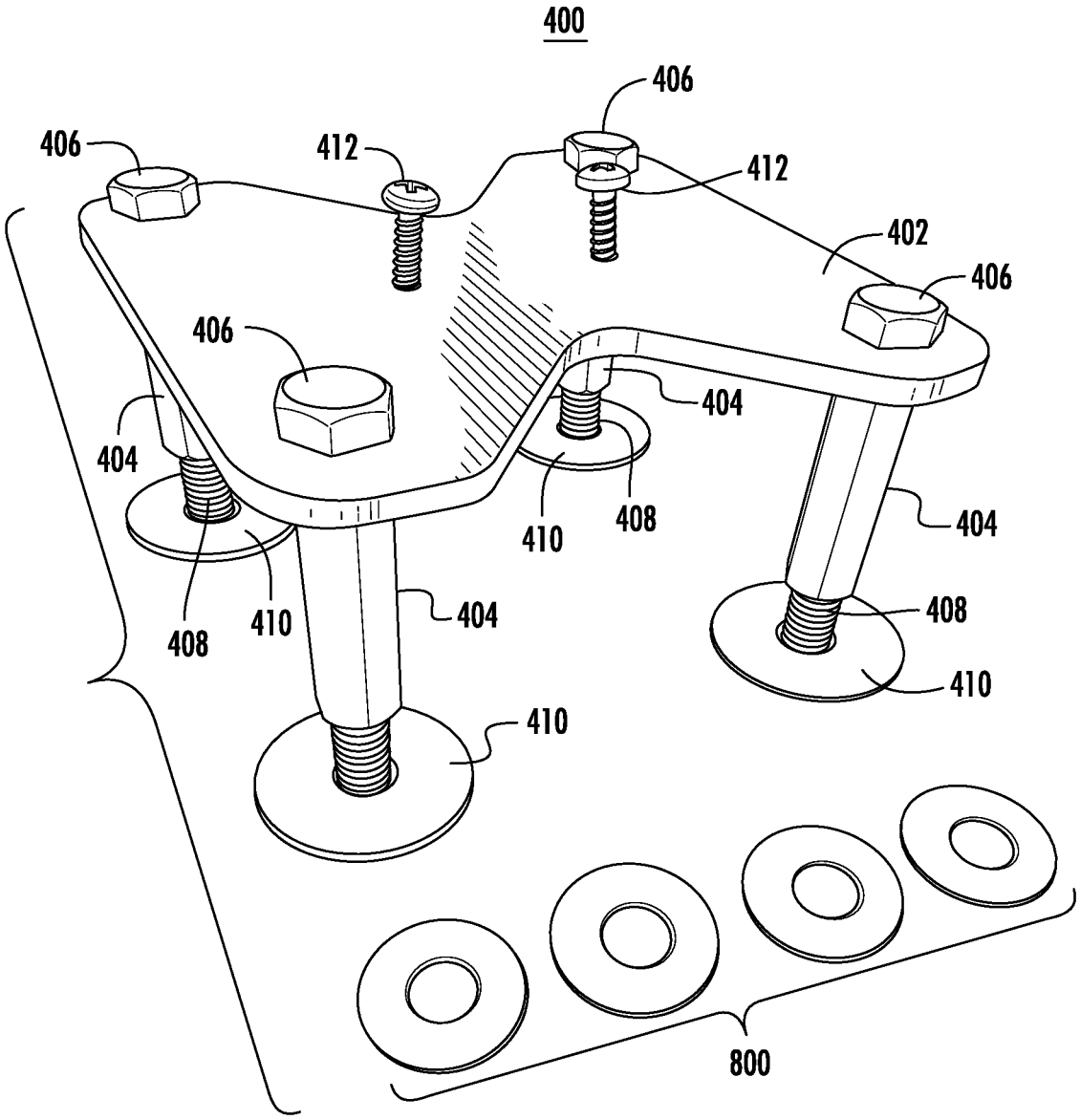
FIGS. 3A and 3B are mostly assembled and disassembled views, respectively, of the main anchoring system section of the embed system of an embodiment of the present invention.
Figure 3B:
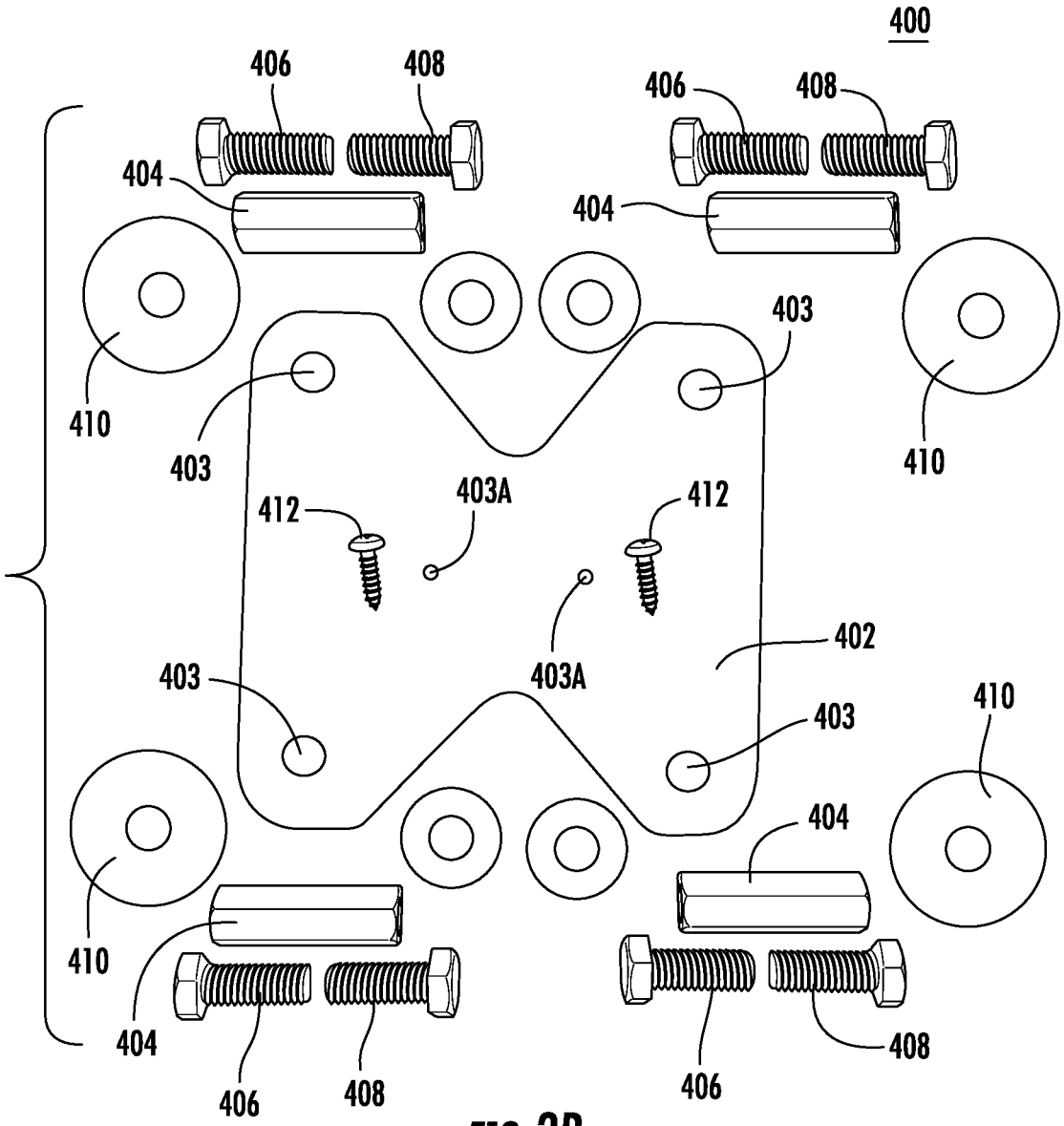

FIGS. 3A and 3B show one instance main anchoring system section of an embed system of the present invention. FIG. 3A shows a main section 400 in a mostly assembled form, while FIG. 3B shows the component elements disassembled. The main section 400 is configured to eventually be embedded in concrete so as to be able to accept a bolt-on engagement between holes in a top plate thereof and bolts at the base of a balcony or landing system.

It should be noted that the main section 400 is illustrated in FIGS. 3A and 3B and in other figures in a configuration that is used during installation in the concrete. As will be discussed in more detail below, the main section 400 will be modified after being secured in the hardened concrete so as to be able to engage with the bolts of the railing.

The plate 402 is configured to lie across the top of the concrete of the balcony or landing. As can be seen in FIG. 3A the plate 402 is configured to extend section 400 of the embed system into a concrete floor by use of longitudinally extending hexagonally cross-sectioned nuts 404. The nuts 404 are long enough to provide interior threading to accept bolts at each end. In particular, the nuts 404 cooperate with the holes 403 of the plate to threadingly engage top bolts 406 and bottom bolts 408 at the tops and bottoms of the nuts 404, respectively.

The plate 402, which is preferably made of a plastic resin, allows precise placement of threaded anchors, each formed by a bottom bolts 408 and a large washer 410, in their required respective locations, corresponding to the hole pattern of the mating part. Being made of a plastic resin allows the receiving plate 402 to isolate most of the receiving plate from moisture and conductivity. The material also sufficiently resists compression forces even though it is not made of metal. While plastic is preferred, the invention is not limited to plastic and other materials, such as metal, carbon fiber, etc., could be used to make the plate.

The shape of the plate 402, for example with its opposite indents 480, is specifically designed to provide installers tool access to the normally hard to reach space around the anchors. This mitigates possible voids or cavities in the concrete under the plate and around the fasteners, ensuring adequate structural strength.

During installation of the embed system in the concrete, the top bolts 406 function to keep the concrete and other debris out of the top female threaded parts of the nuts 404. As will be developed below, the top bolts 406 will eventually be replaced by railing bolts that secure a railing to the plate 402, with railing washers 800, after the concrete has fully hardened. Although the top bolts 406 are not present in the finished product with the railing, they perform an important function; because even a small amount of concrete or other debris in the top of the nuts 404 will foul the threading, affecting the ability to engage the railing bolts to the threads in the tops of the nuts 404.

The bottom of each nut 404 has female threading to accept a bottom bolt 408 in cooperation with a wide washer 410, the combination of the bolt 408 and the wide washer 410 forming an anchor. The washers 410 provide a wide surface area under the concrete and provide strength to the connection, particularly in the vertical direction, between the section 400 and the hardened concrete.

The anchoring system is designed as an assembly of separate components, which provides for less cumbersome shipping and packaging, as compared to the prior art systems.

The threadability of the bolts 408 and the nuts 404 provide the flexibility to control the depth of the anchors around obstacles such as structural steel used in the reinforcement of concrete. The threaded anchor permits the adjustment of the depth of the anchors for deeper or shallower positions offering flexibility while maintaining adequate holding power. Depending on the application different length bolts can be used.

The flat washer 410 at each anchor position offers a wide area of resistance in a 360-degree direction, which distribute stress forces to a wider area of the concrete relative to such an assembly without such washers.

Figure 3C:
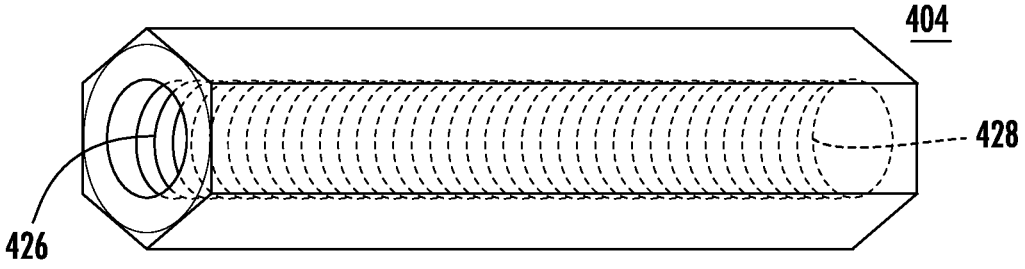
FIGS. 3C and 3D are an x-ray and a sectional view, respectively, of the elongated nut that forms part of the disclosed anchoring system.
Figure 3D:
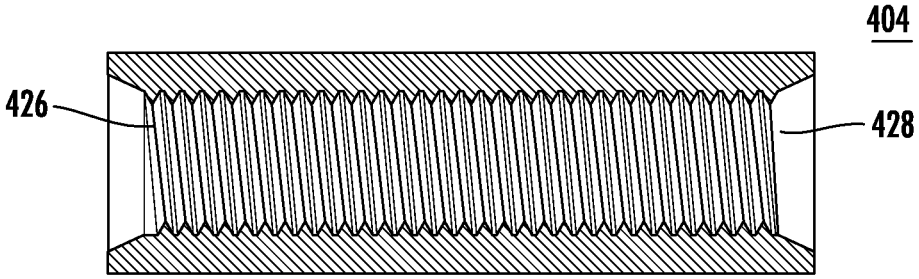

FIGS. 3C and 3D show an x-ray and sectional view, respectively, of the nut 404. As can be seen from these figures, the outer shell of the nut has a hexagonal sectional profile; and, as discussed above, threadings 426 and 428 are provided within the nut 404 starting at respective ends of the nut 404.

Figure 3E:
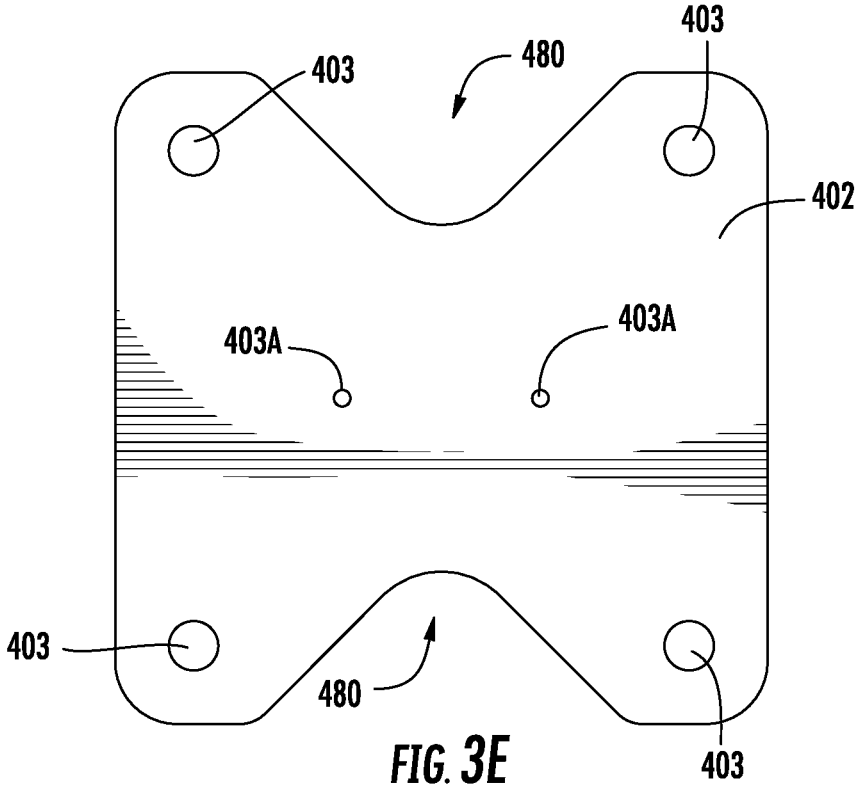
FIG. 3E is a plan view of the plate of the anchoring system, having indents, corner holes and receiving holes.

FIG. 3E is a plan view of the plate 402, having indents 480, corner holes 403 and receiving holes 403A.

Figure 4:
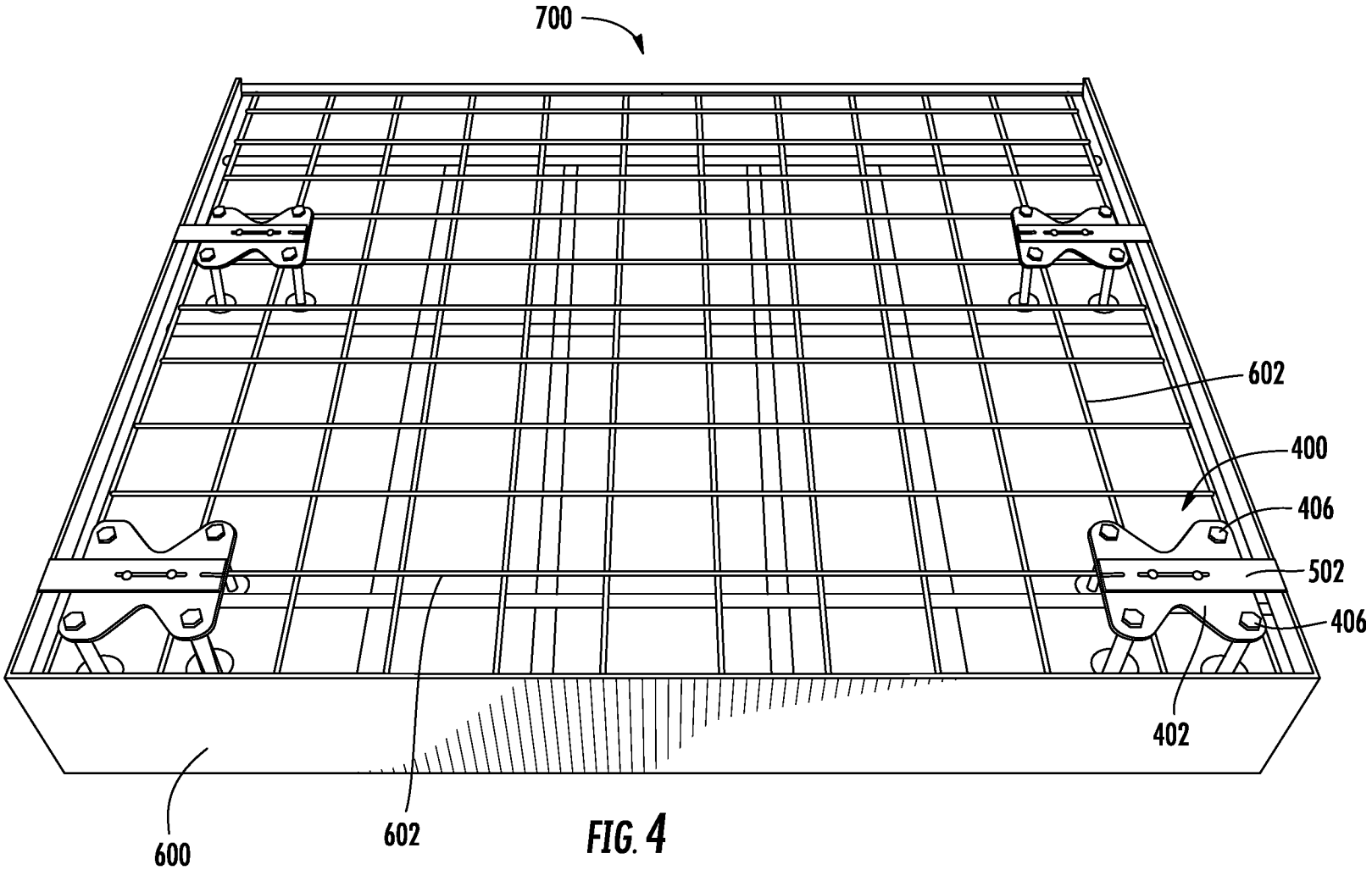
FIG. 4 illustrates the use of four instances of an assembly formed by the main anchoring system and a bracket arm, in relation to a concrete containment form, into which concrete is to be poured.

FIG. 4 illustrates the use of four instances of the section 400 in relation to a concrete containment form, in this exemplary embodiment, a metal pan 600, into which the concrete is to be poured. As can be seen in FIG. 4, each section 400 is affixed to an edge of the pan using a bracket arm 500, illustrated by itself in FIG. 5.

The bracket arm 500 functions as a positioning arm with a slotted channel 504 and provides the ability to adjust and align the position of the anchoring system. This allows an installer to maintain true alignment with adjacent anchoring systems, regardless of irregularities in the concrete form. The positioning bracket arm 500 can be secured to a variety of forming materials, using various mechanical fasteners depending on substrate.

Figure 5:
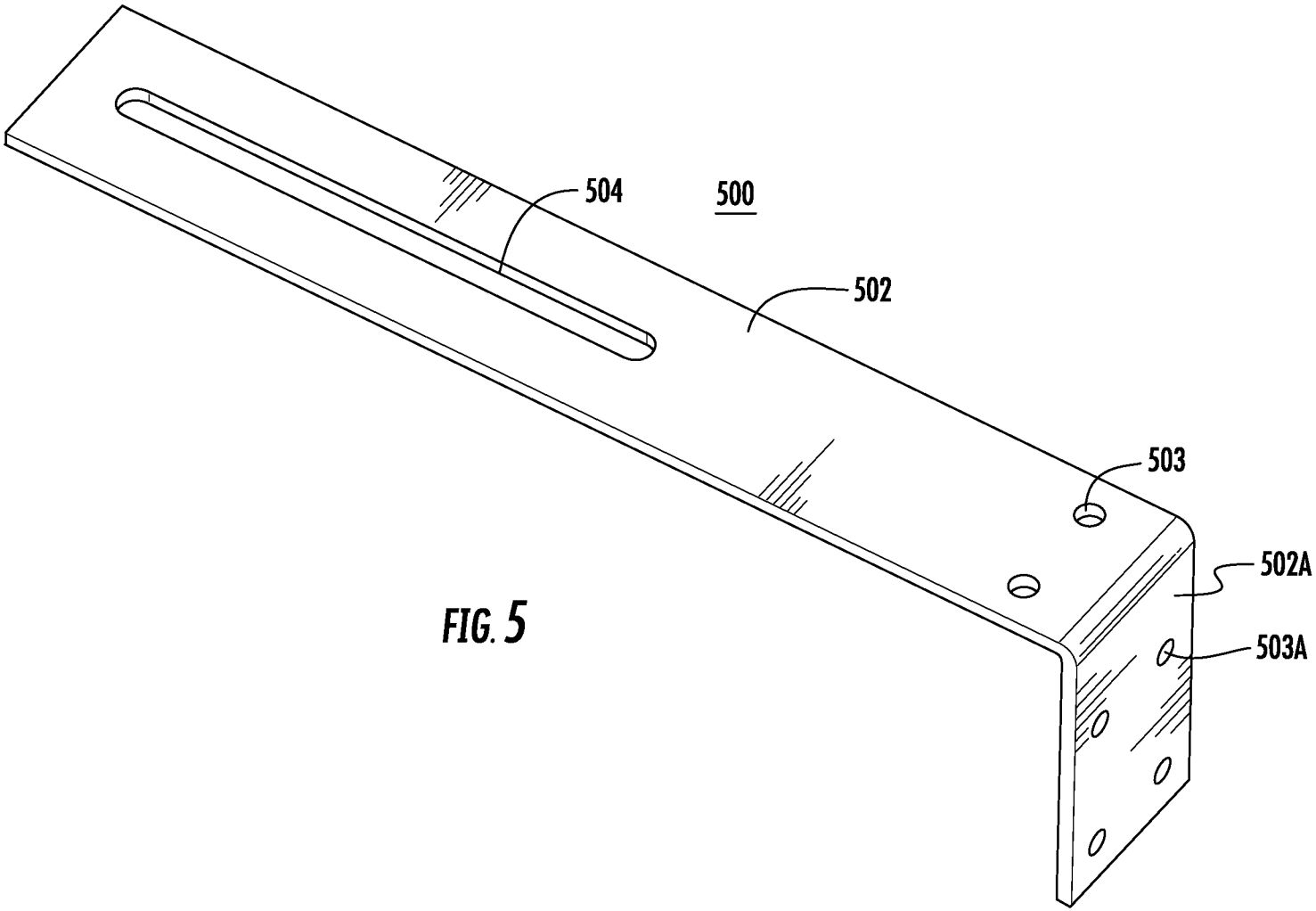
FIG. 5 shows a bracket arm that attaches the anchoring system to the concrete containment form.

In the illustrated embodiment, shown, for example, in FIG. 5, the bracket arm 500 has two main portions, the horizontally extending portion 502 and the vertically extending portion 502A, to form a substantially right angled bracket. The bracket arm 500 is affixed to the section 400 by the screws 412A going through the slot 504 and into the holes 403A of the plate 402. The use of a slot 504 allows for adjustment of the bracket prior to a final tightening. The bracket arm 500 is affixed to the pan 600 using screws 900 into top and side holes 503 and 503A, respectively.

Figure 6A:
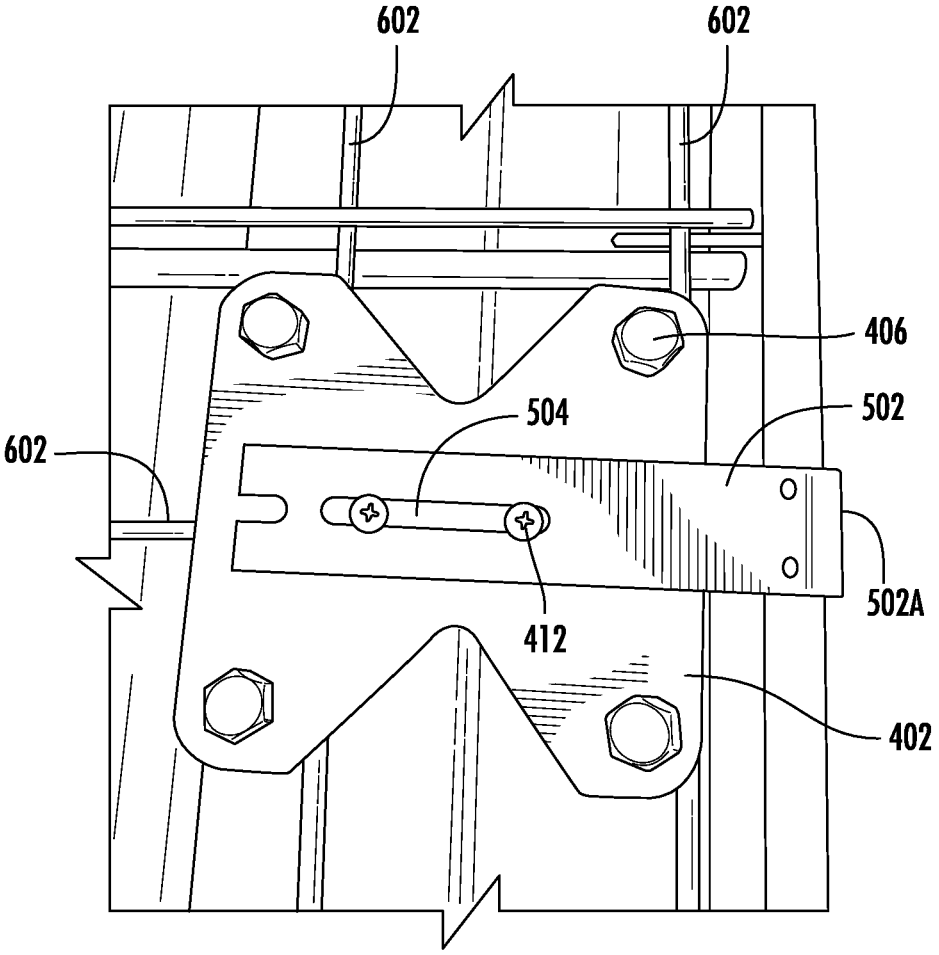
FIG. 6A is a detailed view of one instance of the assembly formed by the anchoring system and the bracket arm as installed in the concrete containment form.

FIG. 6A is a detailed view of one instance of the assembly formed by the bracket arm 500 and the section 400 as installed in a pan 600. Returning to FIG. 4, each assembly is affixed to the pan as discussed above. Reinforcing shafts 602 are arranged in the pan 600. Such shafts provide additional strength to the concrete, once the concrete has hardened.

Figure 6B:
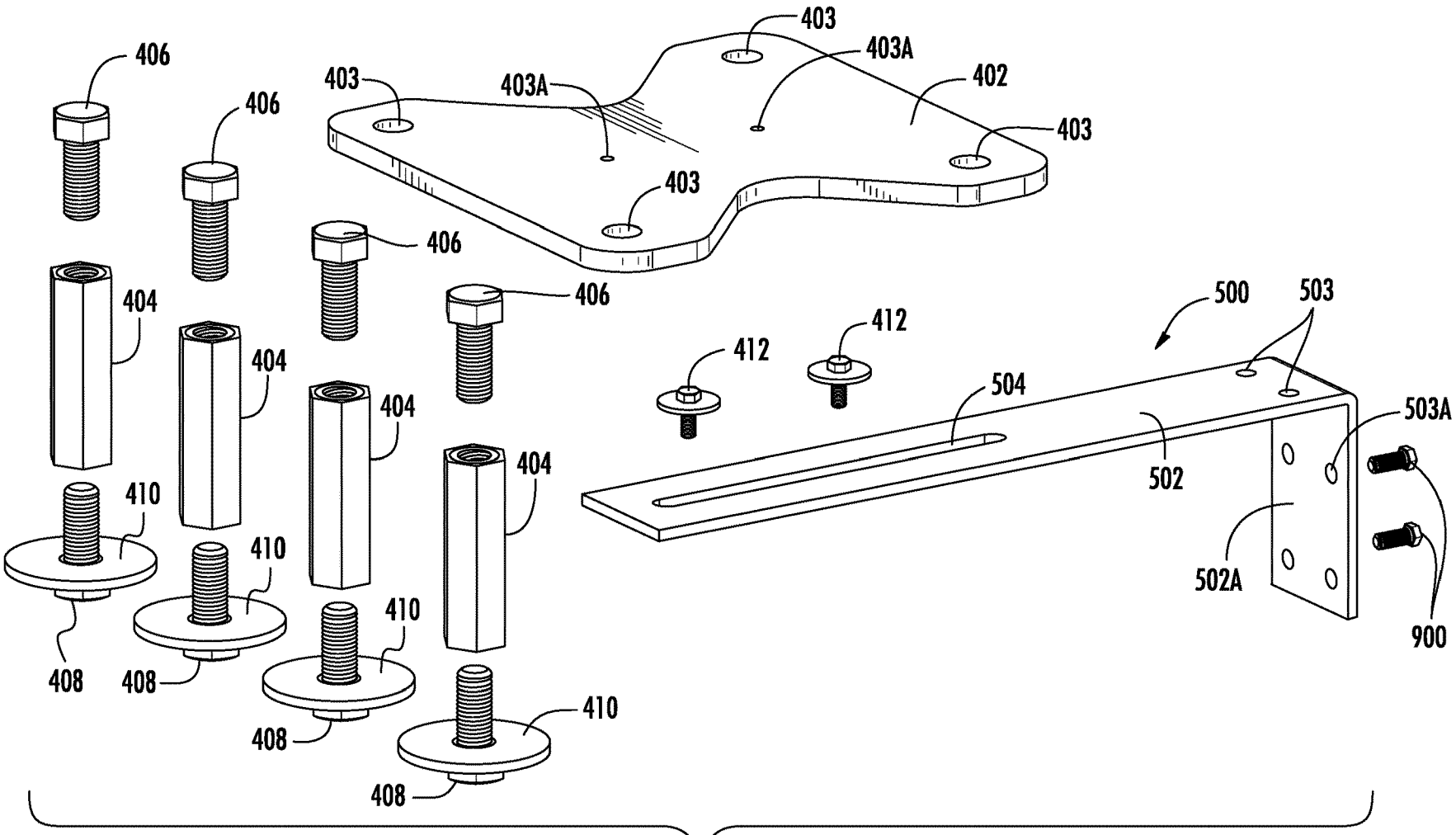
FIG. 6B is a view of the assembly formed by the anchoring system and the bracket arm, in a disassembled state.
Figure 6C:
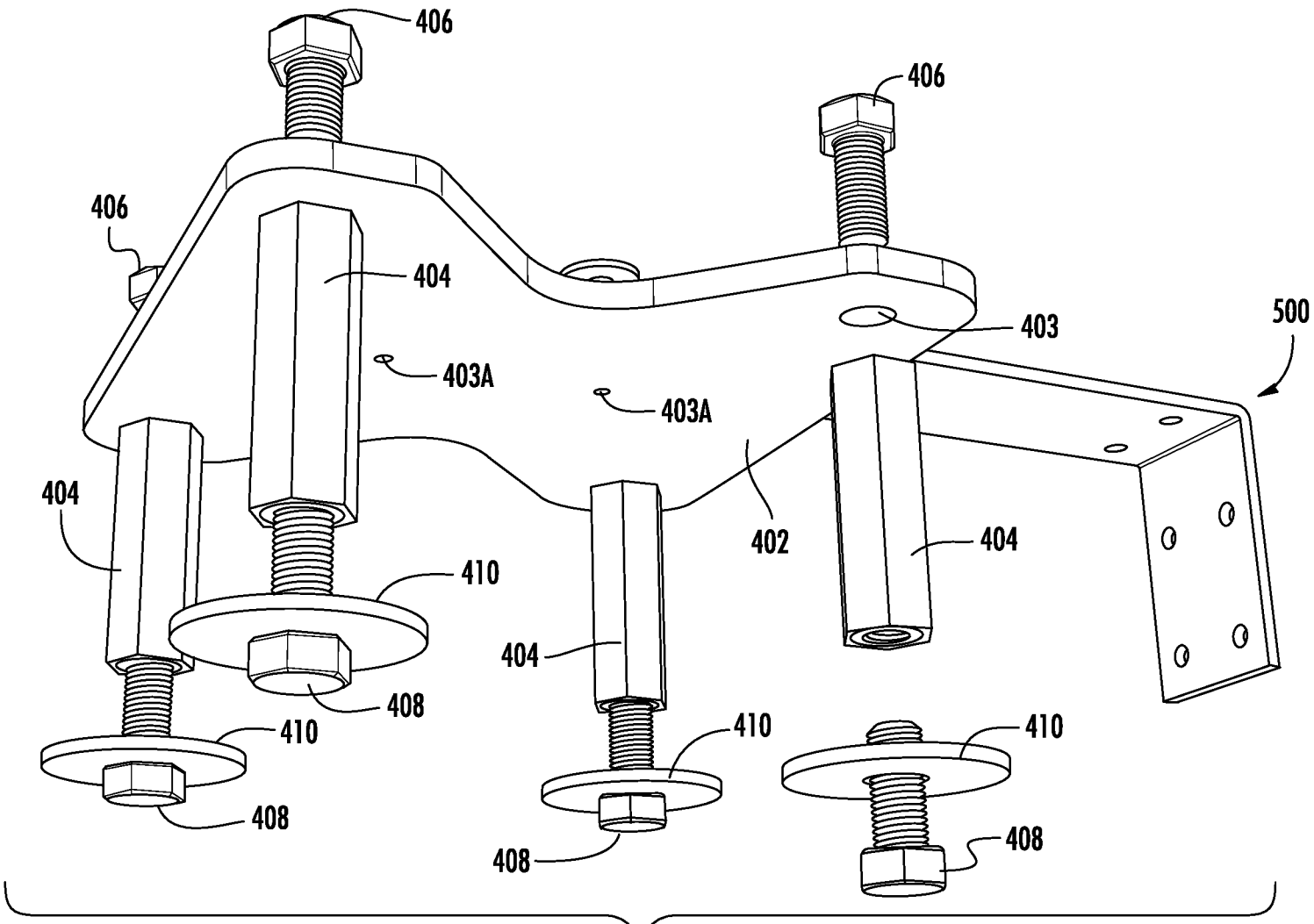
FIGS. 6C and 6D are exploded views of the assembly formed by the anchoring system and the bracket arm.
Figure 6D:
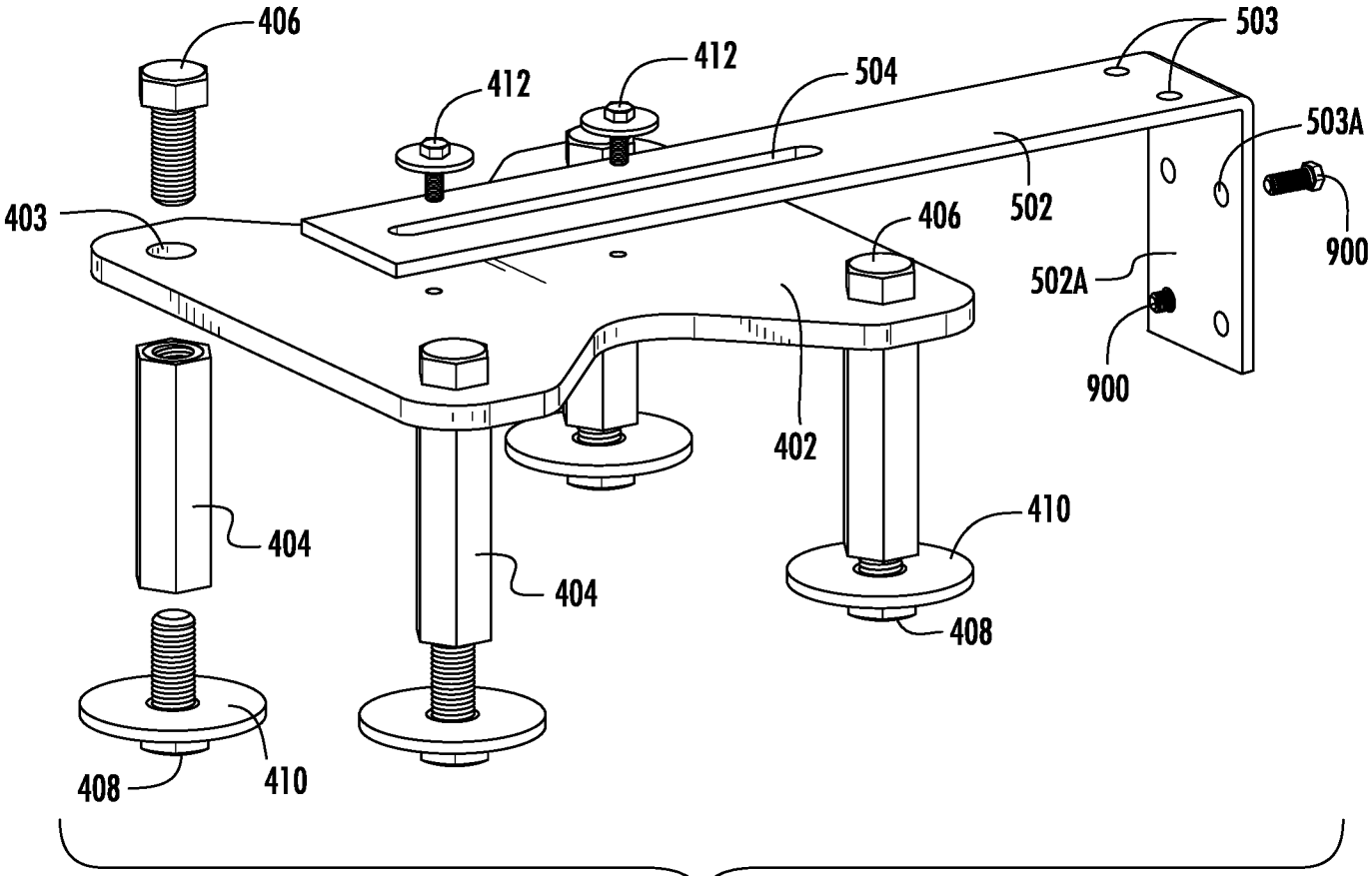
Figure 6E:
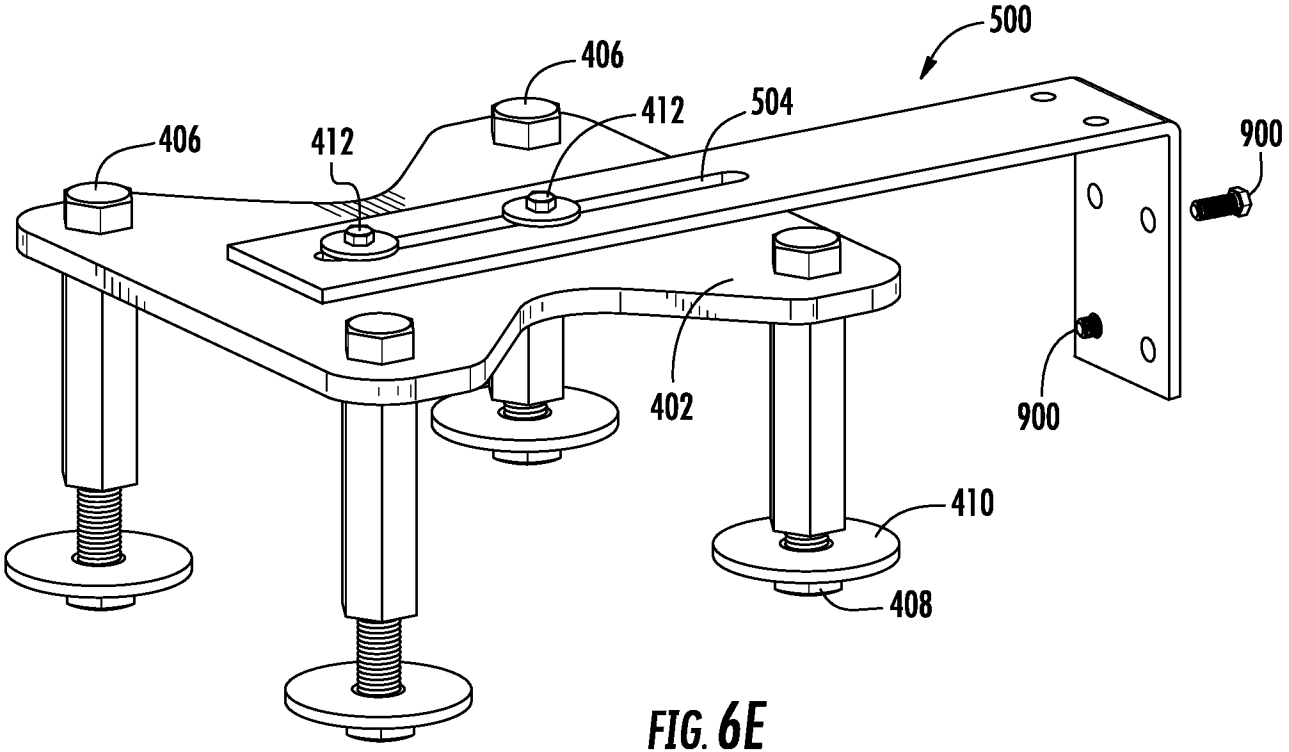
FIG. 6E is a view of an assembled the assembly formed by the anchoring system and the bracket arm, prior to the assembly being affixed to an edge of the concrete containment form.

FIG. 6B is a view of the assembly formed by the bracket arm 500 and the section 400, in a disassembled state. FIGS. 6C and 6D are exploded views of this assembly. FIG. 6E is a view of an assembled assembly formed by the bracket arm 500 and the section 400, prior to the assembly being affixed to an edge of the pan 600. Note that in FIG. 6B, the lower bolts 408 and the large washers 410 have been set to different amounts of extension. This will be discussed below.

Figure 7:
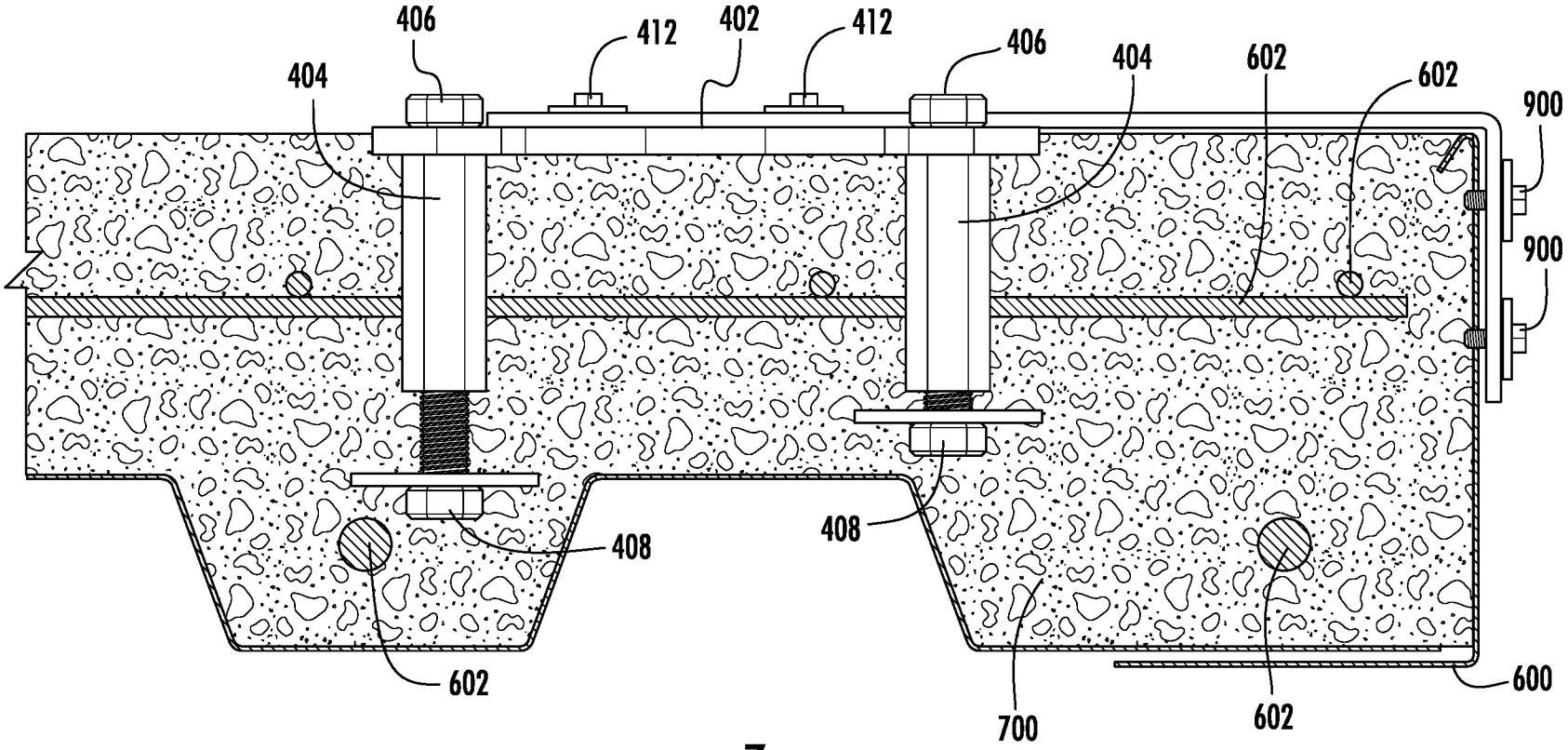
FIG. 7 is a sectional view of one instance of the anchoring system and the bracket arm with concrete having been poured into the concrete containment form.

FIG. 7 is a sectional view of one instance of the assembly with concrete 700 having been poured into the pan 600 and shows the configuration just before the upper bolts 406 are to be removed for replacement by bolts that are associated with the railing. As will be discussed below, the upper bolts 406 are used to ensure the upper threading of the nut 404 remains clean and in proper placement so that the railing bolts will be able to thread properly into the nuts 404. While typically different bolts 802 (see FIG. 8 below) would be provided with the railing base, it is also understood that, if the upper bolts are the same bolts as the ones used for attachment of the railing, those same upper bolts 406 could be re-inserted to secure the railing base, rather than be discarded in favor of new bolts. The bracket arm 500 secures the main section 400 in place until the concrete hardens, after which the brackets are removed before affixing the railing to the plate 402.

As can be seen in FIG. 7, the depth of the anchors (408, 410) differs on each side of the illustrated main section 400. This may be used to avoid, i.e., go around, obstacles such as structural steel used in the reinforcement of concrete, for example reinforcing shafts 602. The threaded anchor (408, 410) permits the adjustment of the depth of the anchors for deeper or shallower positions offering flexibility while maintaining adequate holding power. Depending on the application different length lower bolts 408 can be used.

Figure 8:
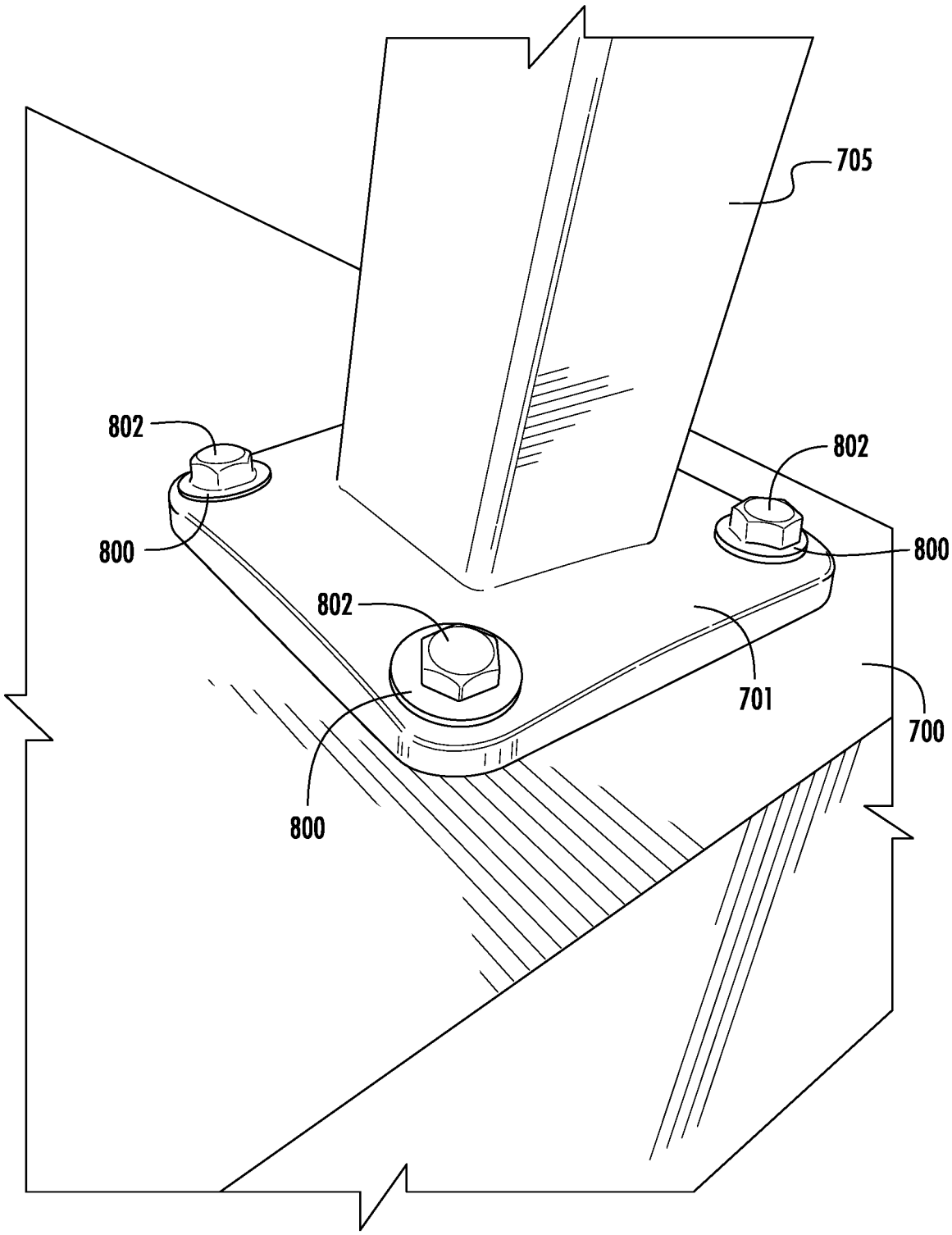
FIG. 8 is a view showing a railing that has been affixed, by railing bolts, to the plate of the anchoring system.

FIG. 8 is a view showing a railing 705 with base plate 701 that has been affixed, by railing bolts 802, to the nuts 404, not visible in this figure, using the threading in the nuts 404 originally used by upper bolts 406. As can be seen in FIG. 8, washers 800 are now used under the heads of the railing bolts 802 to ensure a tight fit. The system is securely fastened, along with the railing, in the concrete 700.

Installation of an embodiment of the embed system is performed as follows: plural instances of the assemblies formed by the bracket arm 500 and the section 400 are affixed, by the angled part of the bracket arms 500, to edges of the pan 600 having the structural reinforcing shafts 602. This configuration is shown in FIG. 4. The heights of the anchors 408, 410 are adjusted as needed to avoid contacting any structural reinforcing shafts 602 or to avoid any other features of the pan 600. The concrete is then poured into the pan 600 to a height that is about level with the plates 402. Once the concrete has cured, the brackets 500 are removed, the plates are cleaned of any concrete, and the upper bolts 406 are removed. The installation of the respective rail bases is effected using bolts 802 and washers 800, as shown in FIGS. 8 and 9A-9C. Alternatively, the upper bolts 406 can be reused for this purpose.

Figure 9A:
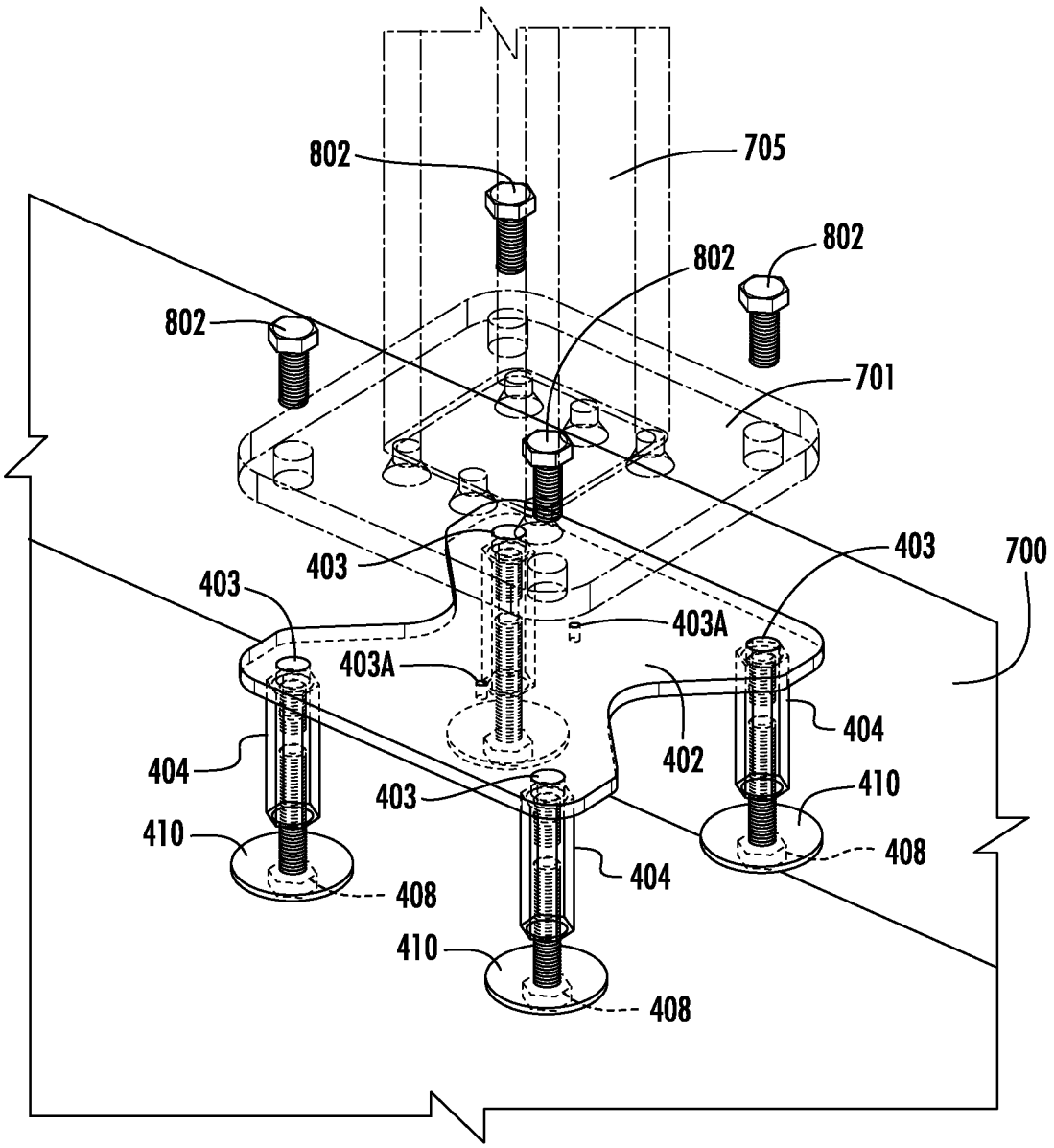
FIGS. 9A-9C are exploded and x-ray views that illustrate how the railing with base plate line up with the main section in attaching the railing to the main section.
Figure 9B:
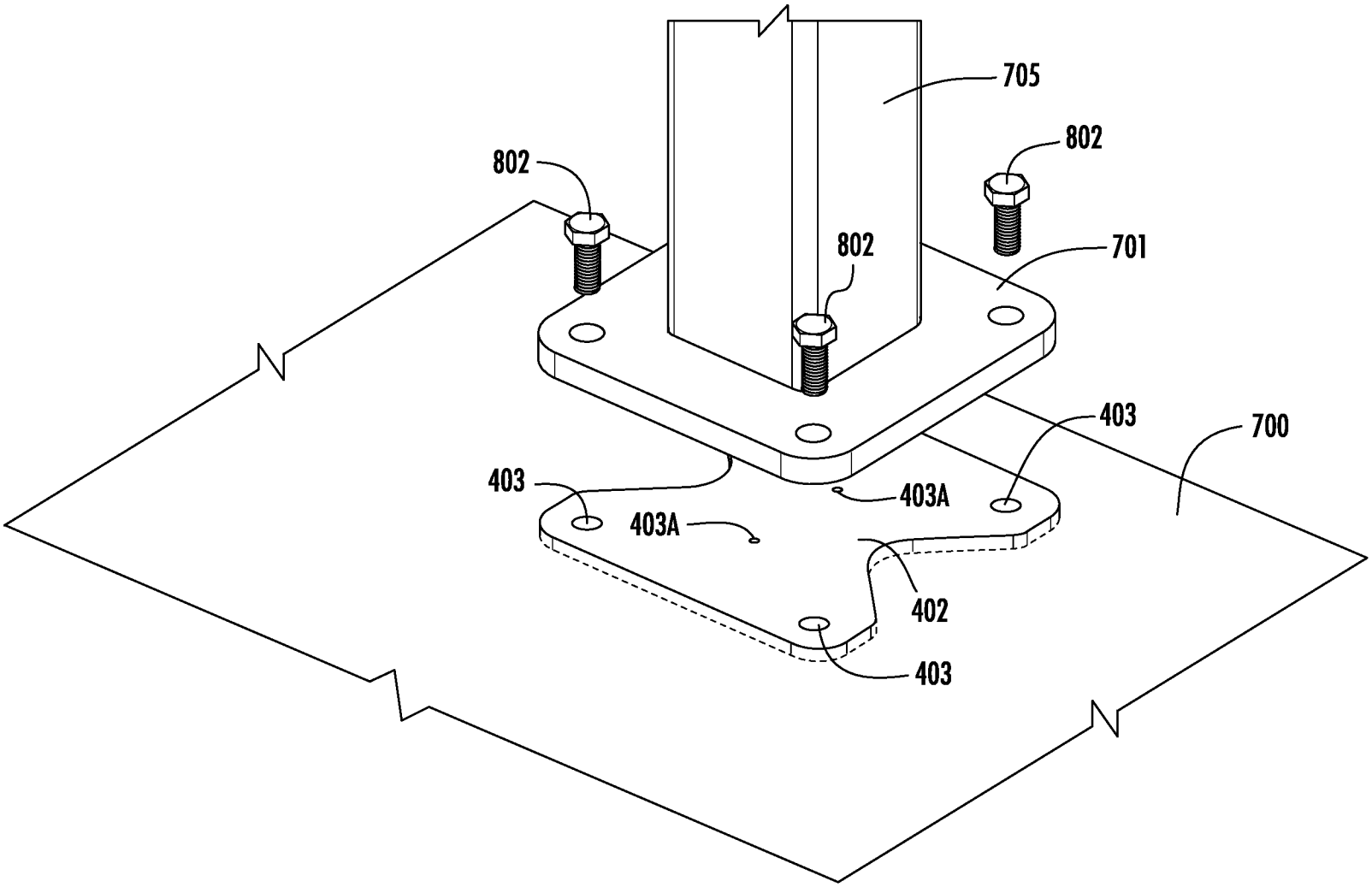
Figure 9C:
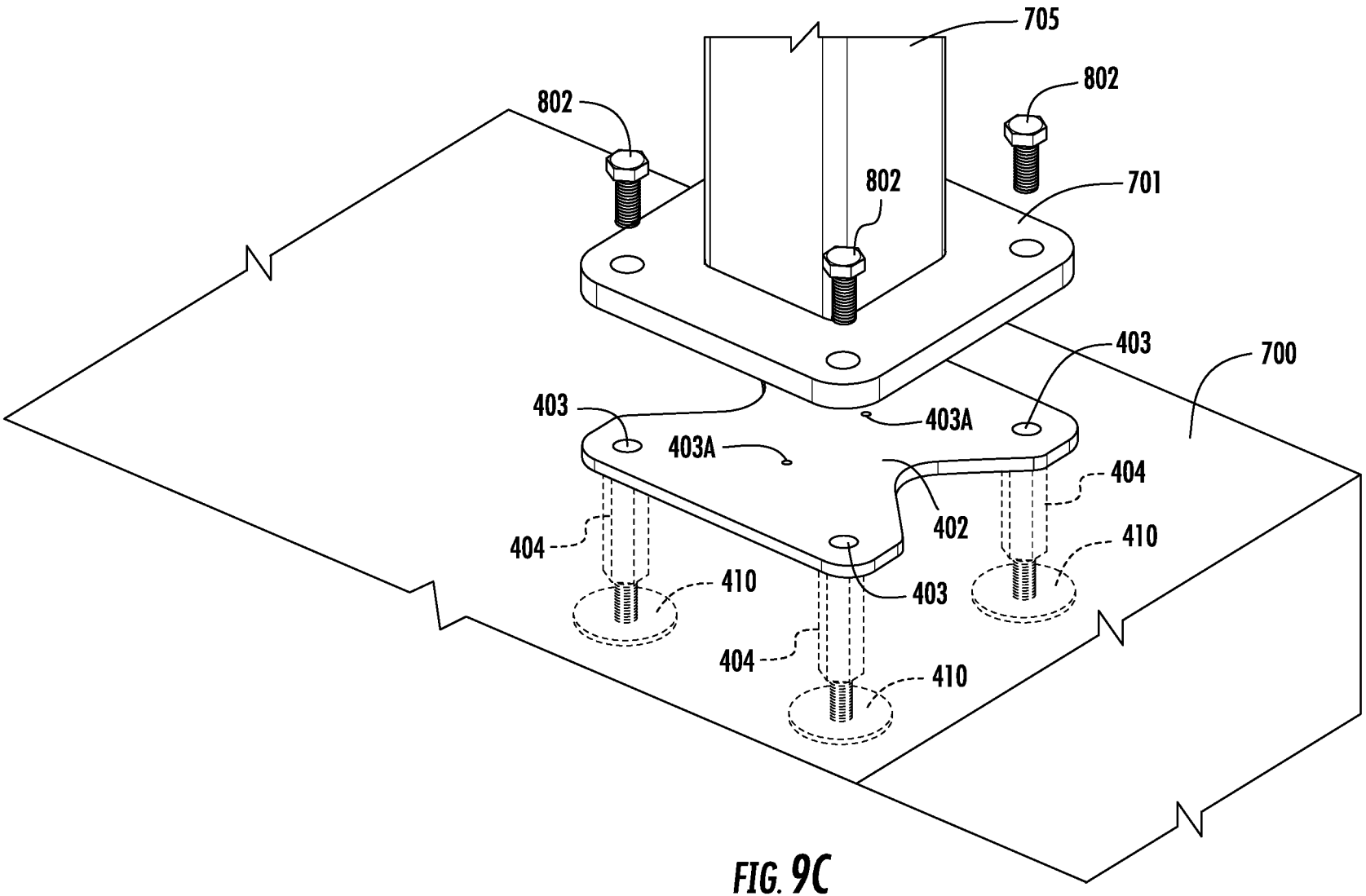

FIGS. 9A-9C are exploded and x-ray views that illustrate how the railing 705 with base plate 701 line up with the main section 400 in attaching the railing post to the main section 400. Note that the washers 800 are not shown in FIGS. 9A-9C to simplify the illustration.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An adjustable railing post-to-substrate embed system for anchoring a railing post having a railing base with plural railing base anchor holes, the system comprising:

a plate, having anchor holes;

a plurality of nuts, a first end of each nut being arranged proximate a respective one of the anchor holes, the first end of each nut being configured to be selectively and removably threadingly engaged, via the respective anchor hole, with one selected from the group consisting of: respective upper protective bolts, and respective bolts of the railing base;

a plurality of anchors, each being configured to adjustably threadingly engage a second end of a respective one of the nuts, distal the respective anchor hole, each of the anchors being individually adjustable in length by threadable engagement with the second end of the respective one of the nuts, so that the distance between an anchor and its corresponding anchor hole can be modified relative to the distance between another of the anchors and its respective anchor hole; and a bracket having a bent end configured to fixedly engage the bracket to an edge of a concrete containment form via bent end screws, and configured to adjustably arrange the plate with respect to the edge of the concrete containment form by affixing the bracket to the plate, wherein the bracket is affixed to the plate by a plate contact screw, and wherein the bracket comprises a slot through which the plate contact screw passes for the adjustable arrangement of the plate with respect to the edge of the metal concrete pour concrete containment form.

2. The system of claim 1, wherein each anchor comprises a lower bolt and a washer.

3. The system of claim 1, wherein the upper protective bolts are configured to be arranged in the first end of the nut, and then selectively removed after a hardening of concrete in the concrete containment form.

4. The system of claim 1, wherein in a case in which the concrete has not yet hardened the selected group consists of the respective upper protective bolts.

5. The system of claim 1, wherein in a case in which the concrete has hardened, the selected group consists of the respective bolts of the railing base.

6. The system of claim 1, wherein each nut comprises first threading at the first end, for threadingly engaging a bolt, and second threading at the second end, for threadingly engaging a respective one of the anchors.

7. The system of claim 1, wherein the plate is made of plastic.

8. The system of claim 1, wherein the plate is made of metal.

9. The system of claim 1, wherein the protective railing bolts and railing base bolts are the same.

10. The system of claim 1, wherein the protective railing bolts and railing base bolts are different.

11. The system of claim 1, wherein the concrete containment form comprises a metal concrete pour pan.

12. The system of claim 1, wherein the railing comprises a guardrail.

13. The system of claim 1, wherein the railing comprises a fence.

14. An adjustable railing post-to-substrate embed system for anchoring a railing post having a railing base with plural railing base anchor holes, the system comprising:

a plate, having anchor holes;

a plurality of nuts, a first end of each nut being arranged proximate a respective one of the anchor holes, the first end of each nut being configured to be selectively and removably threadingly engaged, via the respective anchor hole, with one selected from the group consisting of: respective upper protective bolts, and respective bolts of the railing base;

a plurality of anchors, each being configured to adjustably threadingly engage a second end of a respective one of the nuts, distal the respective anchor hole, each of the anchors being individually adjustable in length by threadable engagement with the second end of the respective one of the nuts, so that the distance between an anchor and its corresponding anchor hole can be modified relative to the distance between another of the anchors and its respective anchor hole; and a bracket having a bent end configured to fixedly engage the bracket to an edge of a concrete containment form via bent end screws, and configured to adjustably arrange the plate with respect to the edge of the concrete containment form by affixing the bracket to the plate;

wherein each nut comprises first threading at the first end, for threadingly engaging a bolt, and second threading at the second end, for threadingly engaging a respective one of the anchors.

15. The system of claim 14, wherein the bracket is affixed to the plate by a plate contact screw, and wherein the bracket comprises a slot through which the plate contact screw passes for the adjustable arrangement of the plate with respect to the edge of the metal concrete pour concrete containment form.

16. The system of claim 14, wherein the upper protective bolts are configured to be arranged in the first end of the nut, and then selectively removed after a hardening of concrete in the concrete containment form.

17. The system of claim 14, wherein the concrete containment form comprises a metal concrete pour pan.

* * * * *